US006872425B2

(12) United States Patent
Kaufold et al.

(10) Patent No.: US 6,872,425 B2
(45) Date of Patent: Mar. 29, 2005

(54) COATED VEHICLE WHEEL AND METHOD

(75) Inventors: Roger W. Kaufold, Pittsburgh, PA (US); Neville C. Whittle, Irwin, PA (US); Edward P. Patrick, Murrysville, PA (US); A. Victor Pajerski, New Kensington, PA (US)

(73) Assignee: Alcoa Inc., Pittsburgh, PA (US)

( * ) Notice: Subject to any disclaimer, the term of this patent is extended or adjusted under 35 U.S.C. 154(b) by 0 days.

(21) Appl. No.: 10/672,455

(22) Filed: Sep. 25, 2003

(65) Prior Publication Data

US 2004/0142109 A1 Jul. 22, 2004

Related U.S. Application Data

(60) Provisional application No. 60/413,359, filed on Sep. 25, 2002.

(51) Int. Cl.[7] ..... B60B 21/10; C23C 4/04; C23C 4/18; C23C 4/00; B05D 1/02

(52) U.S. Cl. ..... 427/404; 427/419.1; 427/290; 427/327; 427/355; 427/450; 427/455; 427/569; 301/95.101

(58) Field of Search ..... 427/404, 419.1, 427/290, 327, 355, 450, 455, 569; 301/95.101; 428/650, 651, 652, 654

(56) References Cited

U.S. PATENT DOCUMENTS

| | | | | | |
|---|---|---|---|---|---|
| 3,579,783 | A | * | 5/1971 | Hayes et al. | 29/894.342 |
| 3,906,894 | A | * | 9/1975 | Pesapane | 118/315 |
| 4,421,821 | A | * | 12/1983 | Matsubara et al. | 428/323 |
| 4,763,392 | A | * | 8/1988 | Fogal et al. | 427/327 |
| 4,895,887 | A | * | 1/1990 | Daimon et al. | 524/265 |
| 5,226,971 | A | * | 7/1993 | Fogal et al. | 134/17 |
| 5,283,121 | A | | 2/1994 | Bordner | 428/380 |
| 5,302,414 | A | | 4/1994 | Alkhimov et al. | 427/192 |
| 5,334,235 | A | | 8/1994 | Dorfman et al. | 75/255 |
| 5,626,674 | A | | 5/1997 | VanKuiken, Jr. et al. | 118/317 |
| 5,795,626 | A | | 8/1998 | Gabel et al. | 427/458 |
| 5,884,388 | A | * | 3/1999 | Patrick et al. | 29/527.2 |
| 6,258,417 | B1 | | 7/2001 | Goswami et al. | 427/452 |
| 6,290,032 | B1 | * | 9/2001 | Patrick et al. | 188/218 XL |
| 6,344,237 | B1 | | 2/2002 | Kilmer et al. | 427/190 |
| 6,365,222 | B1 | | 4/2002 | Wagner et al. | 427/140 |

* cited by examiner

*Primary Examiner*—Deborah Jones
*Assistant Examiner*—Jason Savage
(74) *Attorney, Agent, or Firm*—Gary P. Topolosky

(57) ABSTRACT

A method of coating a vehicle wheel to increase wear and corrosion resistance of the vehicle wheel, includes the steps of providing a vehicle wheel and applying a wear and corrosion resistant coating onto a surface of the vehicle wheel. The coating is applied to at least a tire bead retaining flange of the vehicle wheel. The coating is of particular use with vehicle wheels made of forged aluminum. The coating is selected from tungsten carbide, optionally including cobalt or chrome, a nickel-based superalloy, aluminum and silicon carbide, or stainless steel.

The coating is typically applied to a thickness of about 0.004–0.01 inch. The surface of the vehicle wheel may be prepared by mechanically abrading the surface or chemically etching the surface of the vehicle wheel. The coating may be applied by cold spraying, thermal spraying, or triboelectric discharge kinetic spraying and other similar processes.

41 Claims, 10 Drawing Sheets

COATED VEHICLE WHEEL AND METHOD

CROSS REFERENCE TO RELATED APPLICATION

This application claims the benefit of U.S. Provisional Patent Application No. 60/413,359, filed Sep. 25, 2002, which is hereby incorporated by reference in its entirety.

BACKGROUND OF THE INVENTION

1. Field of the Invention

The present invention relates to vehicle wheels and, more particularly, to truck wheels, such as aluminum truck wheels, having a coating provided in wear areas of the truck wheels and a method of coating the same.

2. Description of Related Art

Vehicle wheels are subjected to extended and rigorous use during the operation of a motor vehicle. As a result of the extended use and rough wear, it is common for the vehicle wheels to need to be replaced on a regular basis. While in use, vehicle wheels are in constant contact with the tires of the motor vehicle, which results in wear of the vehicle wheel due to sliding wear mechanisms such as abrasion and adhesion. Vehicle wheels are also made from steel as an inexpensive alternative to aluminum alloys, however, the use of steel does not alleviate the occurrence of wear in the vehicle wheel. In recent years, aluminum wheels have been substituted for steel wheels because of their lighter weight and attractive appearance without sacrificing strength. Aluminum wheels have become the preferred choice for cars, trucks, sport utility vehicles, and even on large heavy-duty trucks such as tractor-trailers. Unfortunately, wear also occurs in highly loaded vehicles with aluminum wheels.

Under certain specific in-service conditions, truck wheels, such as forged aluminum truck wheels, exhibit a unique wear condition. Specifically, a rim flange area of the aluminum truck wheel wears locally to form a groove that is approximately 0.25–0.5 inch wide and 0.125–0.250 inch deep on average. The dimensions of this wear groove depends typically on wheel service conditions, such as the load carried thereon, road and/or weather conditions, total number of hours in service, rate at which those hours accrued, brand of tire, tire pressure and size of tire. This "wear groove" condition has the potential to compromise the structural integrity of both the vehicle wheel and tire, which is of particular concern in heavy-duty trucks due to their large size and typical high speed interstate driving applications.

Corrosion resistance of truck wheels is also a factor in the amount of wear the vehicle wheel will exhibit under practical road conditions. This is particularly true with aluminum truck wheels. Several factors may accelerate corrosion under service conditions. These "accelerators" include tire rim vibration and elevated temperatures inside the tire during operation of the truck or other vehicle. Corrosion generally decreases the mechanical strength of the tire rim and may lead to the destruction of the tire and wheel. With extended wear and corrosion, the groove discussed previously becomes larger and may form sharp groove edges that may cut into the tire and if large enough require, the rim to be machined back to shape. This "wear groove" condition may also be dangerous if it affects the structural integrity of the wheel and the service of the tires mounted thereon.

In view of the foregoing, a need exists to protect a new or used vehicle wheel from wear and corrosion. A need further exists for a wear and corrosion resistant aluminum vehicle wheel, particularly a wear and corrosion resistant aluminum truck wheel that improves upon vehicle wheels that are now commonly formed of aluminum. Additionally, a need exists for a simple method of improving wear and corrosion resistance of vehicle wheels, for example by coating the vehicle wheel with a protective layer.

SUMMARY OF THE INVENTION

The present invention is generally directed to a method of coating a vehicle wheel to increase wear and corrosion resistance of the vehicle wheel. The method generally includes the steps of providing a vehicle wheel and applying a wear and corrosion resistant coating onto a surface of the vehicle wheel. The method may also include a step of mechanically buffing the coating. Optionally, the surface of the vehicle wheel may be prepared by mechanically abrading the surface of the vehicle wheel, which may include mechanical roughening, knurling, and abrasive grit blasting of the surface of the vehicle wheel. The surface of the vehicle wheel may also be prepared by chemical etching or by high-pressure water blasting of the surface of the vehicle wheel.

The coating is preferably applied to a tire bead seat area including a tire bead retaining flange and/or tire bead seat of the vehicle wheel. The vehicle wheel may be made of forged aluminum or cast aluminum. The coating may include tungsten carbide, and/or cobalt and chrome, a nickel-based superalloy, aluminum and silicon carbide, or stainless steel. The coating may also be made of a composition including nickel, chromium, iron, silicon, and boron and optionally chromium carbide or tungsten carbide. The coating may be applied to a thickness of about 0.004–0.01 inch.

The coating may be applied by cold spraying, thermal spraying, and triboelectric discharge kinetic spraying. The coating may also be applied by high velocity combustion, low velocity combustion, plasma spray, and twin arc spraying. Optionally, the coating may be applied by any method that improves wear conditions at temperatures up to about 1200° F.

The present invention is also generally directed to a method of coating an existing vehicle wheel to improve wear and corrosion resistance of the vehicle wheel. The method according to this embodiment generally includes the steps of providing a used vehicle wheel, preparing a surface of the used vehicle wheel, and applying a wear and corrosion coating onto the surface of the vehicle wheel with the coating applied at least to a tire bead seat area of the vehicle wheel.

The present invention is also broadly directed to a method of coating any type of vehicle component to improve wear resistance of the vehicle component. The method according to this embodiment generally includes the steps of providing a vehicle component and applying a wear and corrosion coating onto a surface of the vehicle component. The coating is preferably applied to at least a portion of the vehicle component.

DESCRIPTION OF THE PREFERRED EMBODIMENTS

The present invention is directed generally to a method of applying a wear and corrosion resistant coating on a vehicle wheel. While the present invention is discussed in terms of a vehicle wheel, one skilled in the art recognizes that the present method may be applied to any type of vehicle component that is subject to wear and corrosion.

Figure 1:
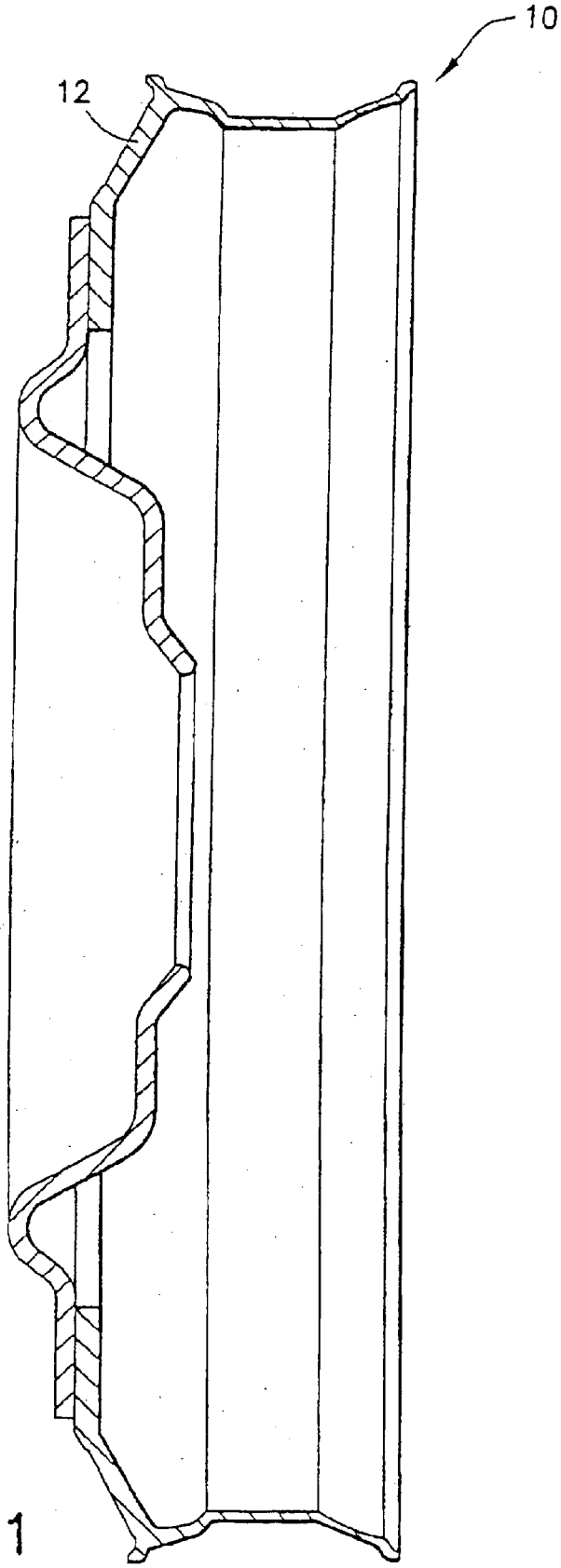
FIG. 1 is a cross sectional view of a vehicle wheel showing inner and outer tire contacting areas onto which a coating is applied in accordance with the present invention.
Figure 2:
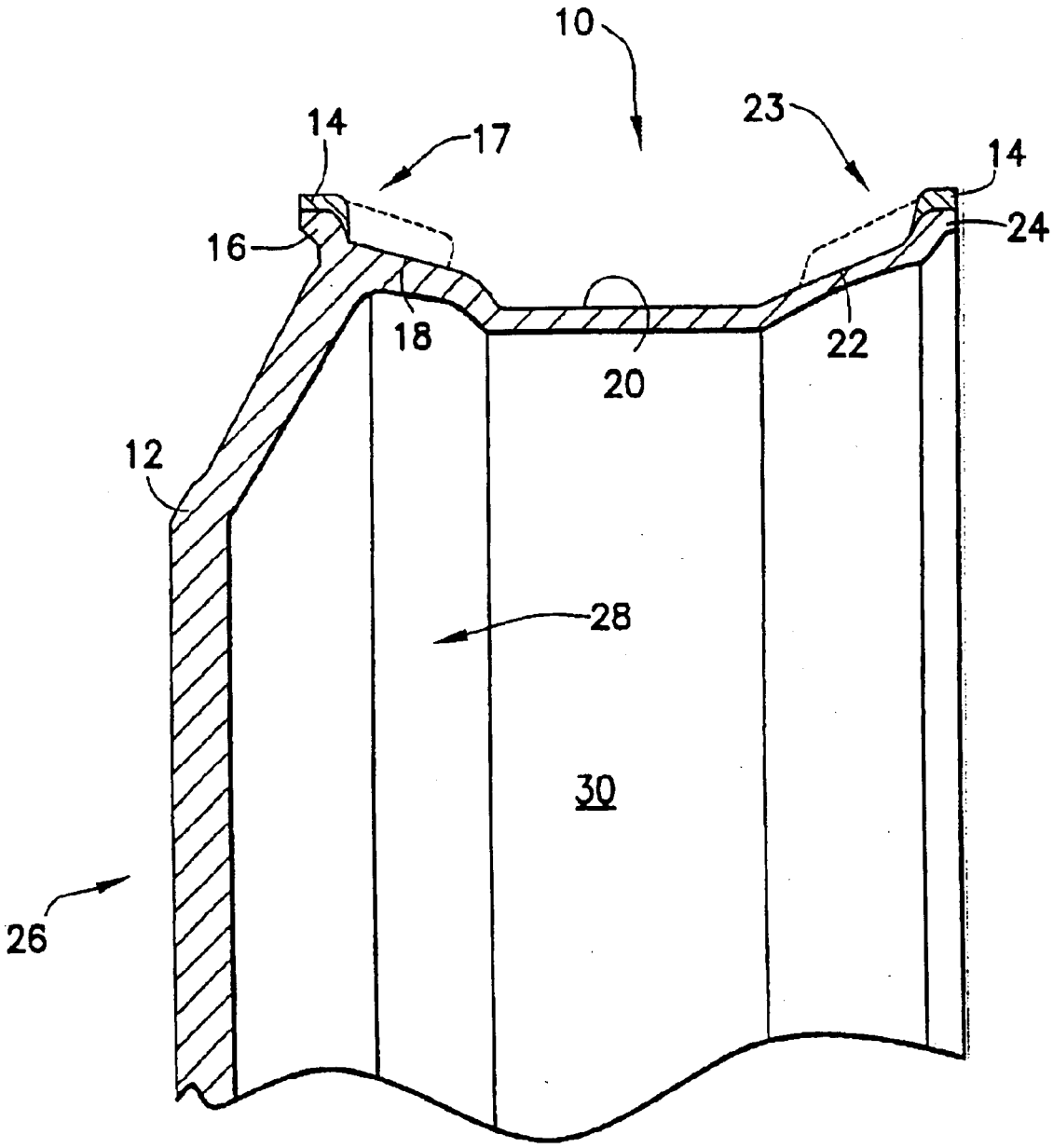
FIG. 2 is a cross sectional view of a portion of the vehicle wheel shown in FIG. 1.

Referring to FIGS. 1 and 2, a vehicle wheel 10 in accordance with the present invention is shown. The vehicle wheel 10 is comprised of a wheel rim 12, upon which a coating 14 is applied in accordance with the present invention. The vehicle wheel 10 and, more particularly, the wheel rim 12 may be made of any material suitable for motor vehicles, such as steel. Preferably, the vehicle wheel 10 is made of an aluminum alloy, and is more preferably in the form of a forged aluminum vehicle wheel 10. The vehicle wheel 10 may also be made of cast aluminum. In one aspect of the present invention the vehicle wheel 10 is a forged aluminum truck wheel.

The wheel rim 12 is made by conventional forging methods known in the art. The wheel rim 12 is generally comprised of tire bead seat areas 17, 23. The tire bead seat area 17 includes an outboard tire bead retaining flange 16 and outboard tire bead seat 18. The tire bead seat area 23 includes an inboard tire bead seat 22 and an inboard tire bead retaining flange 24. A drop center well is located therebetween the tire bead seat area 17 and the tire bead seat area 18.

The vehicle wheel 10 further includes a closed end 26 and an open end 28. The open end 28 of the vehicle wheel 10 defines an opening 30 to receive an axle (not shown) of a motor vehicle, as is commonly known in the art. The closed end 26 of the vehicle wheel 10 faces outward from the body of the motor vehicle that forms the exposed face of the vehicle wheel 10.

As indicated previously, the present invention is directed generally to applying the wear and corrosion resistant coating 14 onto the tire bead seat areas 17, 23 of the wheel rim 12 of the vehicle wheel 10. While the coating 14 is preferably applied to the tire bead retaining flanges 16, 24 and the coating 14 may also be applied to the tire bead seat 18, 22 of the tire bead seat areas 17, 23. The coating 14 is a protective overlay that adds a localized layer of material onto the wheel rim 12 to improve the wear resistance of regions of anticipated wear and/or corrosion damage. The coating 14 is preferably applied to the tire bead seat areas 17, 23. Wear between the tire and wheel rim 12 typically occurs in the tire bead seat areas 17, 23, causing the "wear groove" problem described previously.

The wear resistant coating 14 of the present invention generally includes carbides such as tungsten, chrome and the like, cermets, 300/400 series stainless steel and nickel-based superalloys including Hastalloy and the like. It is known by those skilled in the art that other aluminum alloys, carbides, oxides, metals and cermets may also be used for the coating 14 in accordance with the present invention.

The coating 14 may be applied alone onto the tire bead seat areas 17, 23, or in combination with additional coatings (not shown) of aluminum, aluminum alloys, carbides, oxides, metals and/or cermets. The coating 14 may be provided in a number of forms. For example, the coating 14 may be in the form of a powder, wire, rod, tape, cloth or any combination thereof, and subsequently applied to the vehicle wheel 10.

In one embodiment of the vehicle wheel 10, the coating 14 is a tungsten carbide cobalt coating. More particularly, the coating 14 has a nominal chemistry of about 85% W—Cr, 12% Co, and 4% C. One manufacturer, for example, of coatings having this chemistry, as well as other acceptable coatings for use in the present invention, are manufactured by Praxair, Inc. For example, wear resistant coatings provided by Praxair, Inc. suitable for use as the coating 14 include: LW107 (a tungsten, carbide, cobalt, chrome composition), LW101 (a tungsten, carbon, cobalt composition), LW108 (a tungsten, carbon, nickel and chromium composition), LN110 (a nickel, chromium, iron, silicon, boron composition, including 25% chromium carbide) and LN108 (a nickel, chromium, iron, silicon and boron composition).

The coating 14 provides wear and corrosion resistance for the vehicle wheel 10 and, more particularly, the tire bead retaining flanges 16, 24 of the tire bead seat areas 17, 23 of the wheel rim 12. For example, the coating 14 provides resistance to in-service wear conditions as well as adequate protection from corrosive elements such as road salt, toxic debris, etc. It is also desirable for the coating 14 to have sufficient adhesion to the tire bead seat areas 17, 23 of the wheel rim 12. Moreover, it is advantageous if the coating 14 does not affect the mechanical properties of the wheel rim 12 of the vehicle wheel 10 or any other vehicle component onto which the coating 14 may be applied in accordance with the present invention. While described herein as being applied to tire bead seat areas 17, 23 of the wheel rim 12, the coating 14 is preferably applied to the tire bead retaining flanges 16, 24, and may also be applied to the entire surface of the wheel rim 12, including the tire bead seat 18, 22 and drop-center well 20.

In addition to the preferred wear resistant coating chemistries and surface properties noted above, a similar matching of coefficients of thermal expansion between the vehicle wheel 10 made of aluminum alloy and the coating 14 is desired to prevent premature coating adhesion failure.

The application of the wear resistant coating 14 to the wheel rim 12 may occur by a number of different processes. One preferred coating deposition process is cold gas spraying, as disclosed in U.S. Pat. No. 5,302,414, the disclosure of which is incorporated herein by reference. In the process of cold gas spraying, a coating is applied by spraying a high velocity flow of powder, which is in solid state, at a temperature which is lower than the melting point of the powder material.

Other coating application processes that may be used in the present invention are set forth in U.S. Pat. No. 5,795,626, which is incorporated herein by reference. These methods include coating deposition processes, triboelectric discharge kinetic spraying and thermal spray technologies including high velocity combustion, low velocity combustion, plasma spray and twin wire arc spray. The foregoing processes are well known in the art. Moreover, any application technique that adds a layer locally on a substrate, typically metal substrate, for improving wear conditions or resistance at low temperatures (i.e. less than about 1200° F.), may be utilized in connection with the method of the present invention.

With many coating processes known in the art where mechanical bonding mechanisms dominate, adhesion often relies on the cleanliness and surface topography of a substrate. Although surface preparation is a critical step in some prior art coating processes and particularly affects coating adhesion and failure, it is not a necessary step in the present invention. For example, in a preferred application process of cold spraying, the need for a preliminary surface preparation step may be eliminated because the process "self cleans" the tire bead seat areas 17, 23 during deposition. However, if desired, the surface of the wheel rim 12 may be prepared prior to applying the coating 14. Some surface preparation techniques that may be used in accordance with the present invention include abrasive grit blasting, high pressure water jet blasting, mechanical roughening such as knurling, chemical etching and/or machining. Optionally, the surface may be cleaned without the use of mechanical methods with the use of chemical solvents. The method of the present invention may also eliminate traditional wheel masking steps, as properly stacked wheels during the coating operation will allow for the self masking of non-coated critical surfaces.

Upon selection of the proper type of coating 14, the coating 14 is applied to the wheel rim 12 of the vehicle wheel 10. The coating 14 is preferably applied primarily to the tire bead seat areas 17, 23 of the wheel rim 12, as indicated previously. The coating 14 is preferably applied to a thickness between about 0.004–0.01 inch to provide protection from wear and corrosion. More preferably, a thickness of about 0.004 inch is utilized on the vehicle wheel 10.

Preferably, the coating 14 is applied to the vehicle wheel 12 with an adequate adhesion to the tire bead seat areas 17, 23 to prevent coating bond failure during use under conventional operational driving conditions. The conventional operational driving conditions often allow the vehicle wheel 10 to be exposed to corrosive and erosive environments, such as inclement weather conditions including rain, snow, and sleet, as well as road surface debris including salt and the like. To ensure adequate adhesion, the coating preferably includes properties such as 8,000 psi on average bond strength.

EXAMPLE

FIGS. 3–10 illustrate wear data as measured on tests performed on four sets of aluminum forged heavy-duty truck wheels 10 (A–D). The four sets of aluminum forged wheels 10 (A–D), each having a different coating, were measured for wear after various miles of use. Wear of the four sets of aluminum forged truck wheels 10 (A–D) were measured with the coatings 14 (A–D) set forth in Table 1.

TABLE 1

| Truck Wheel | Coating |
|---|---|
| A | No Coating |
| B | Al—Si Coating |
| C | Hastalloy Coating |
| D | Tungsten Carbide Coating |

The wear of the four sets of aluminum forged vehicle wheels 10 (A–D) were tested at the following intervals: 0 miles; 5,000 miles; 10,000 miles; 20,000 miles; 40,000 miles; 80,000 miles; and 155,000 miles. A cross section of the vehicle wheel 10 (A–D) was taken and the wear of the vehicle wheel 10 (A–D) was measured at points along a 1 inch width profile from the inside of the vehicle wheel 10 (A–D) to the outside of the vehicle wheel 10 (A–D) (i.e., substantially at the tire bead retaining flanges 16, 24) and plotted in FIGS. 3–10 on the X-axis. The Y-axis represents the depth of the tire in inches mounted on the vehicle wheel 10 (A–D). A smaller depth indicates greater wear of the tire, and a larger depth indicates a decreased amount of wear of the tire.

Figure 3:
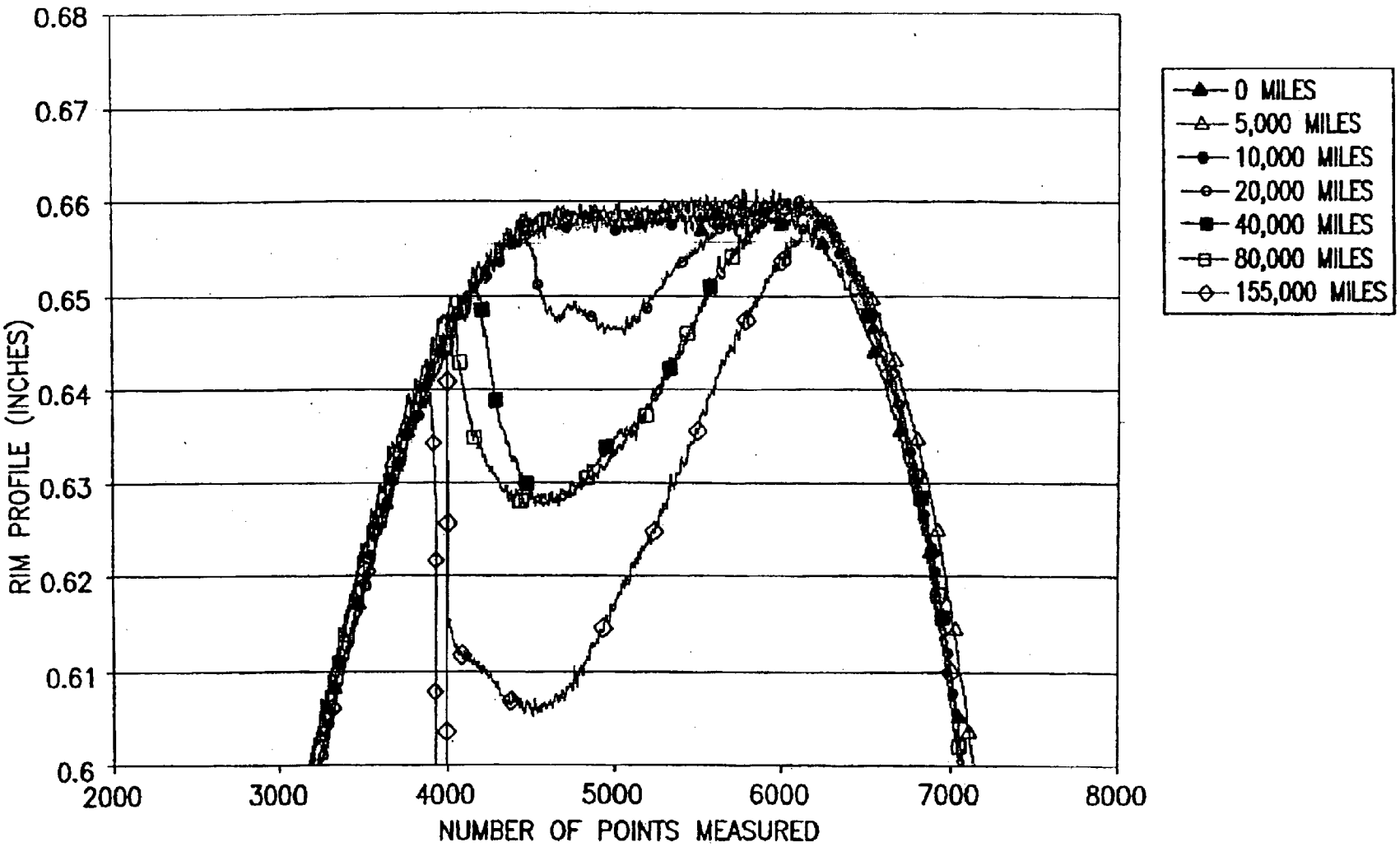
FIG. 3 is a graph of wear resistance of a closed end of an uncoated vehicle wheel.
Figure 4:
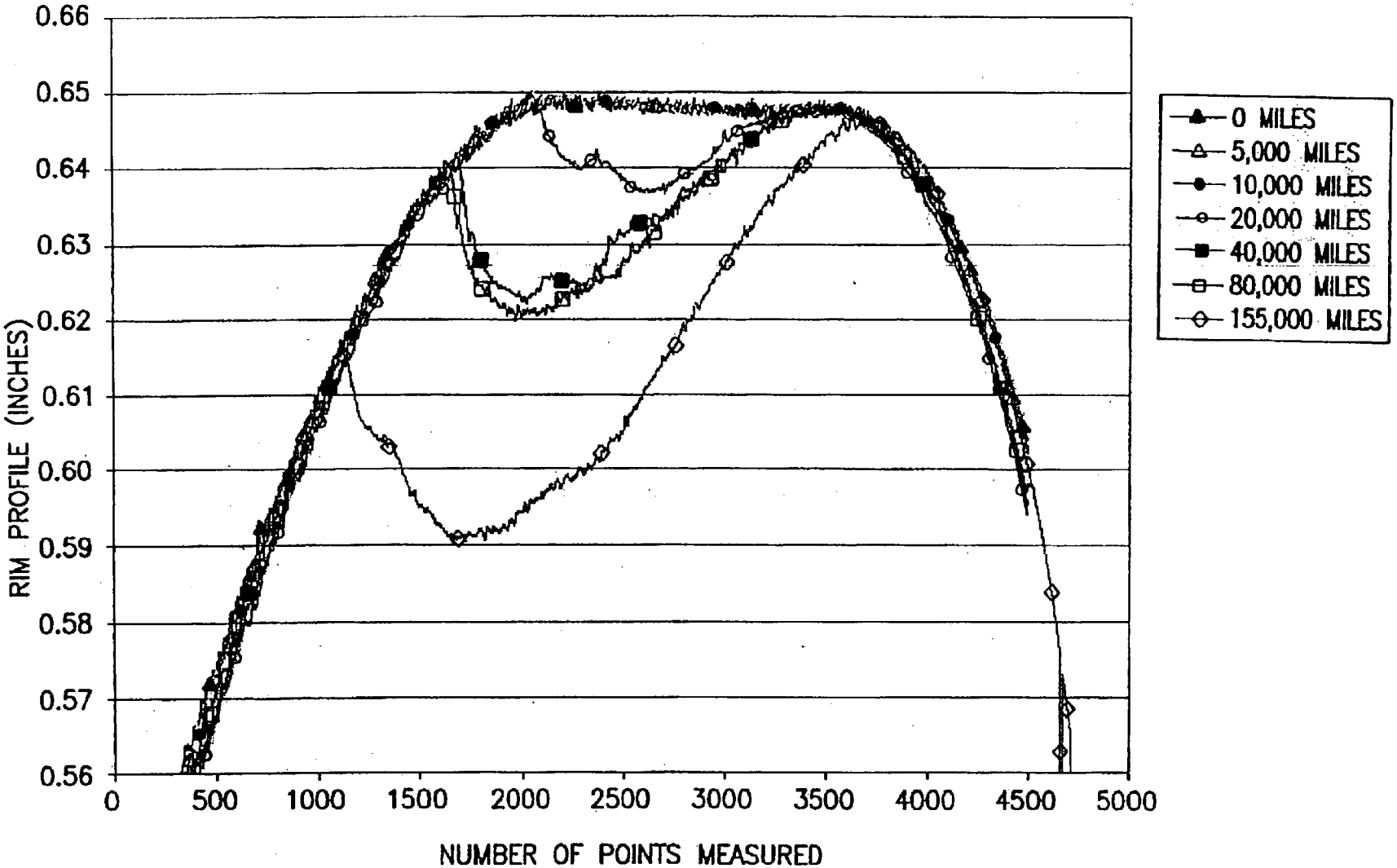
FIG. 4 is a graph of wear resistance of an open end of the uncoated vehicle wheel of FIG. 3.

FIG. 3 illustrates the wear of a vehicle wheel 10A with no coating and is applied to the closed end 26 of the vehicle wheel 10A. FIG. 4 illustrates the wear of the vehicle wheel 10A with no coating applied to the open end 28 of the vehicle wheel 10A. The vehicle wheel 10A having no coating illustrates the greatest amount of wear damage with a presence of wear indicated at about 20,000 miles. This wear significantly increases by 155,000 miles. Additionally, the test results do not indicate a significant difference in wear between the closed end 26 of the vehicle wheel 10A and the open end 28 of the vehicle wheel 10A.

Figure 5:
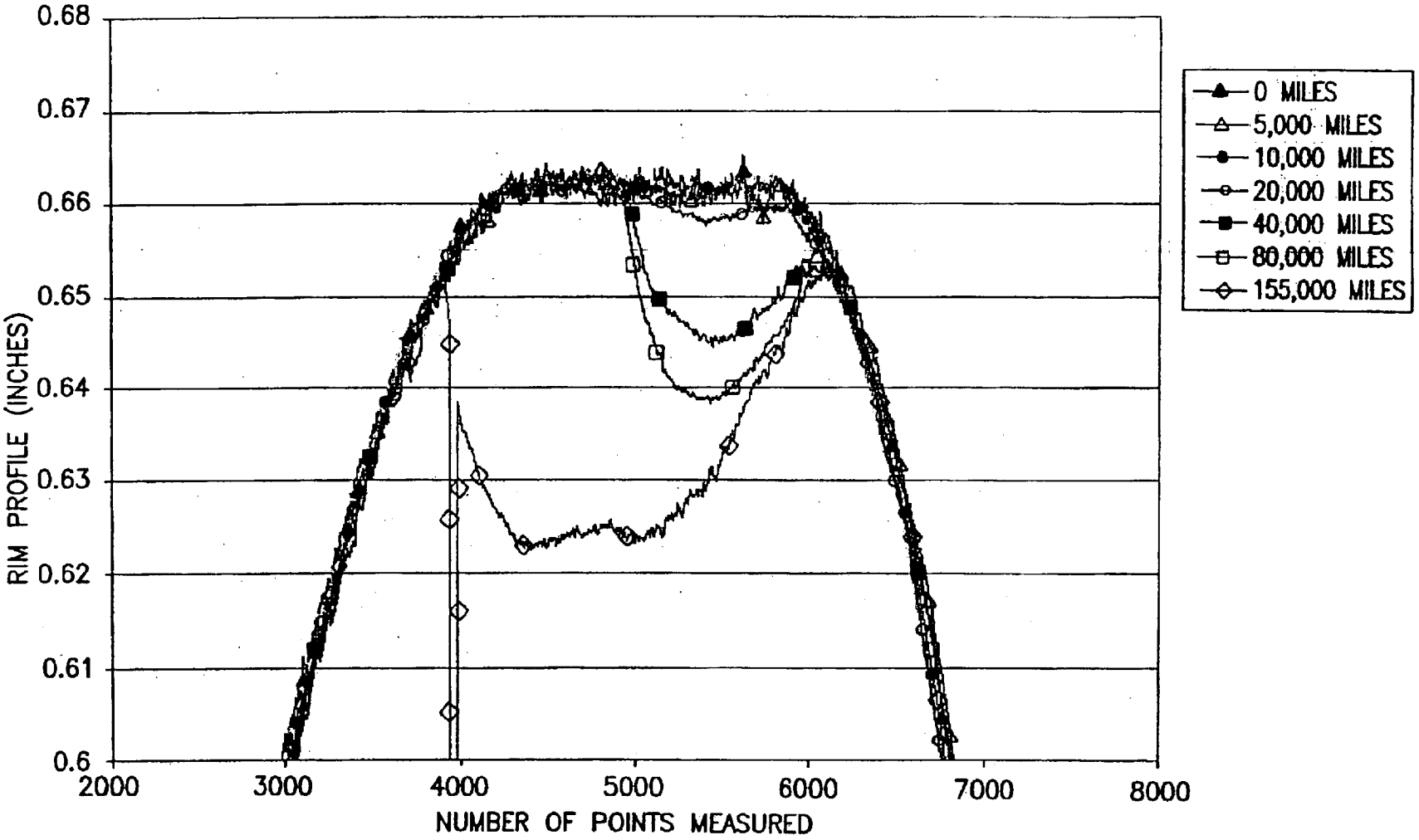
FIG. 5 is a graph of wear resistance of a vehicle wheel having an Al—Si coating applied to the closed end of the vehicle wheel.
Figure 6:
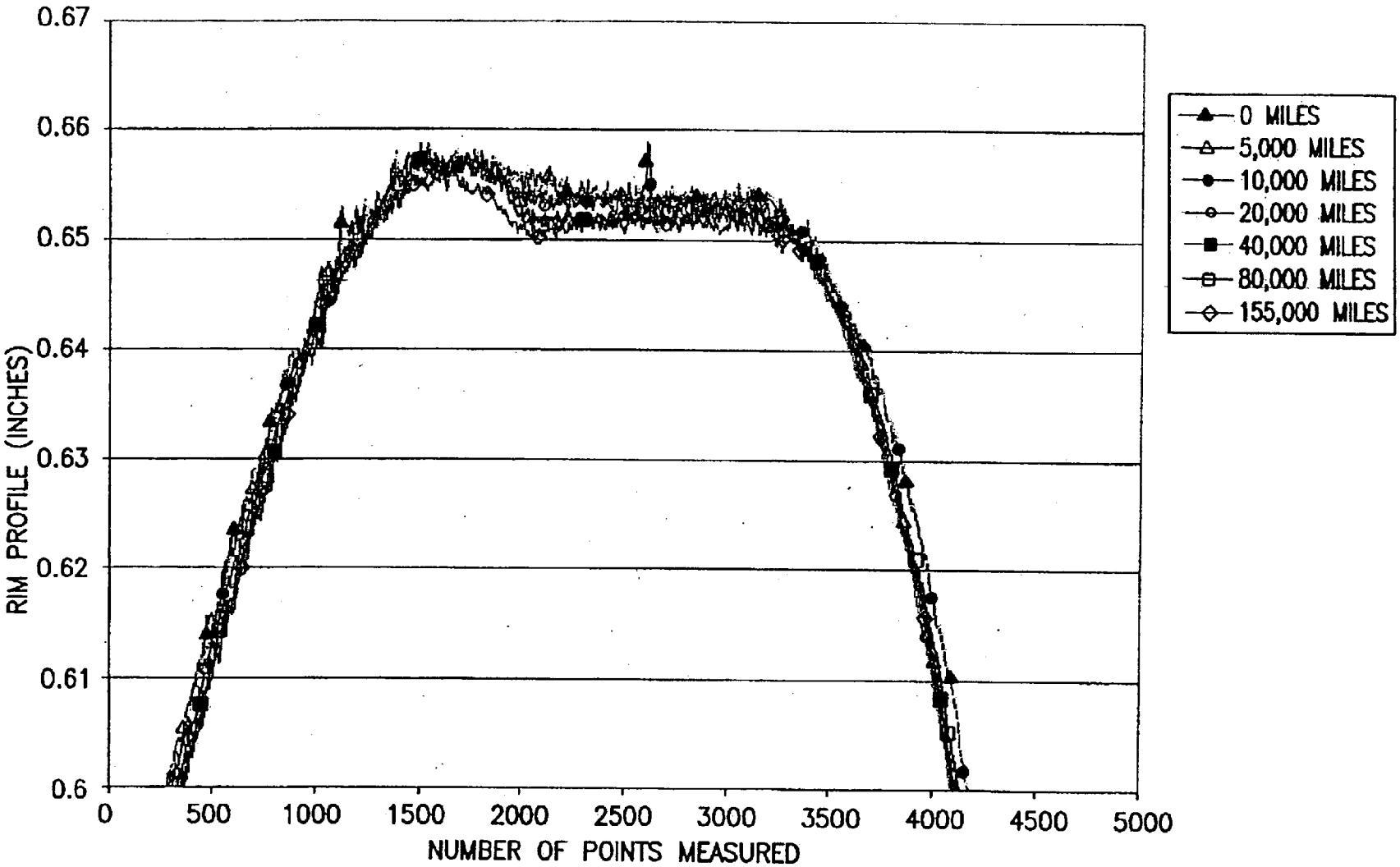
FIG. 6 is a graph of wear resistance of a vehicle wheel having an Al—Si coating applied to the open end of the vehicle wheel.

FIGS. 5 and 6 illustrate the wear resistance of the closed end 26 and open end 28 of a vehicle wheel 10B having an Al—Si coating 14. The Al—Si coating 14 includes about 50–75% SiC and was applied to the vehicle wheel 10B at a thickness of 0.004–0.006 inch. While the Al—Si coating 14 provided greater wear resistance than the vehicle wheel 10A having no coating, initiation of wear occurred at about 40,000 miles, and gradually increased through 155,000 miles of use of vehicle wheel 10B.

Figure 7:
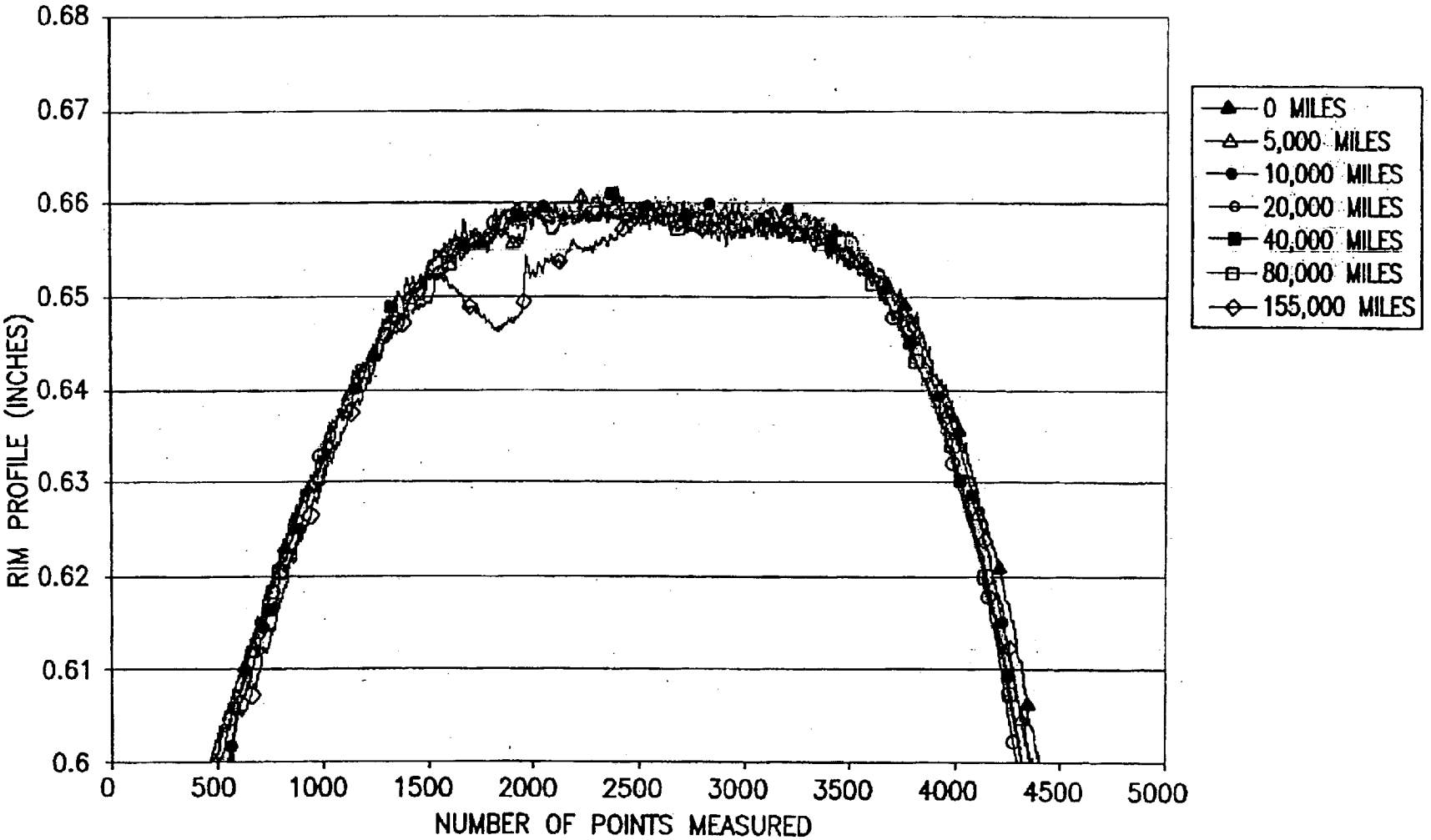
FIG. 7 is a graph of wear resistance of a vehicle wheel having a nickel-based superalloy coating applied to the close end of the vehicle wheel.
Figure 8:
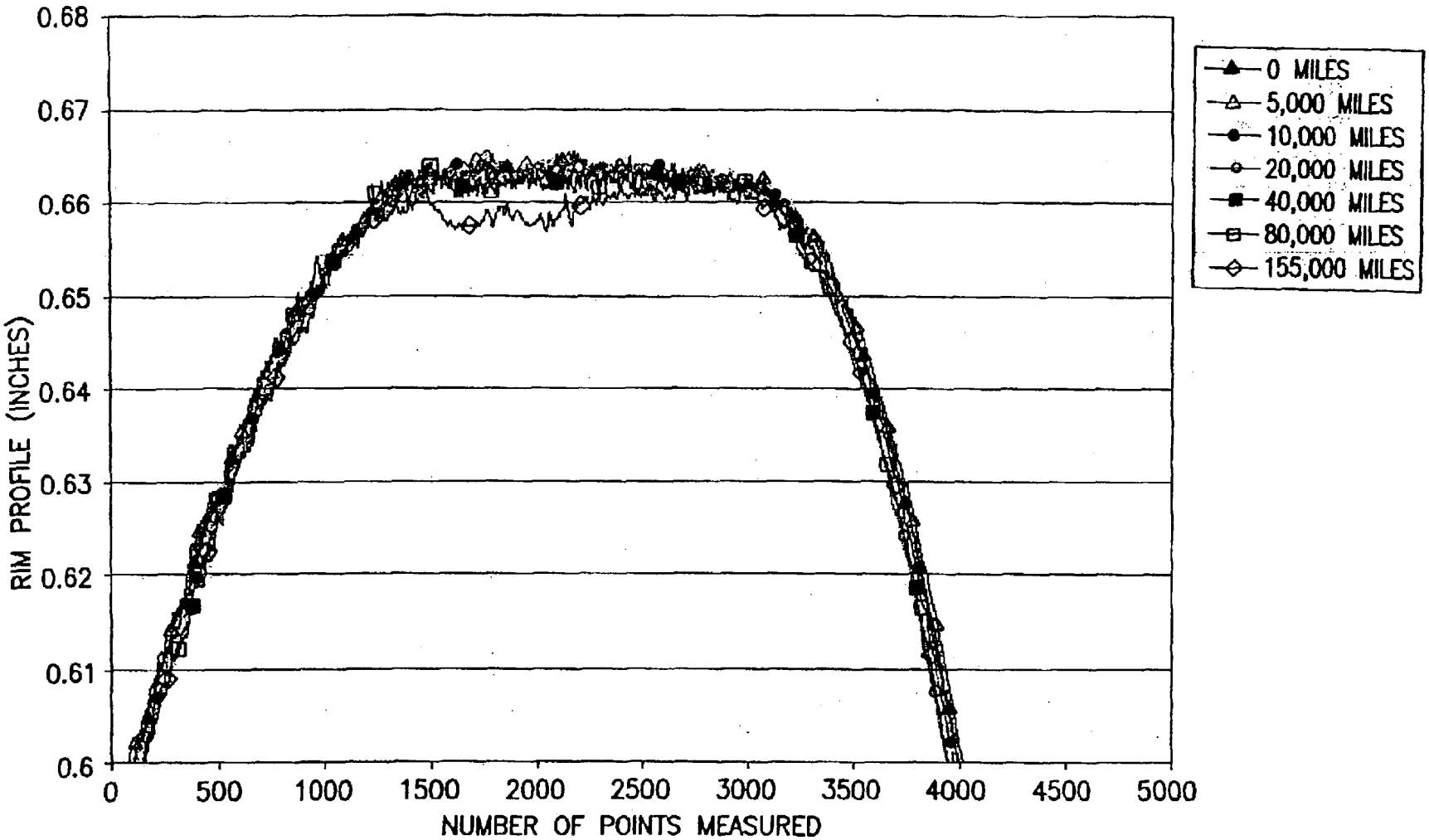
FIG. 8 is a graph of wear resistance of a vehicle wheel having a nickel-based superalloy applied to the open end of the vehicle wheel.

FIGS. 7 and 8 illustrate the wear resistance of the closed end 26 and open end 28 of a vehicle wheel 10C having a nickel-based superalloy coating, such as Hastalloy. The composition of the nickel-based coating includes a nickel-chrome base and was applied to the vehicle wheel 10C at a thickness of 0.004–0.006 inch. The results for the nickel-based superalloy coated vehicle wheel 10C demonstrates even greater wear resistance in comparison with the Al—Si coated wheel 10B, showing no wear until about 155,000 miles of use.

Figure 9:
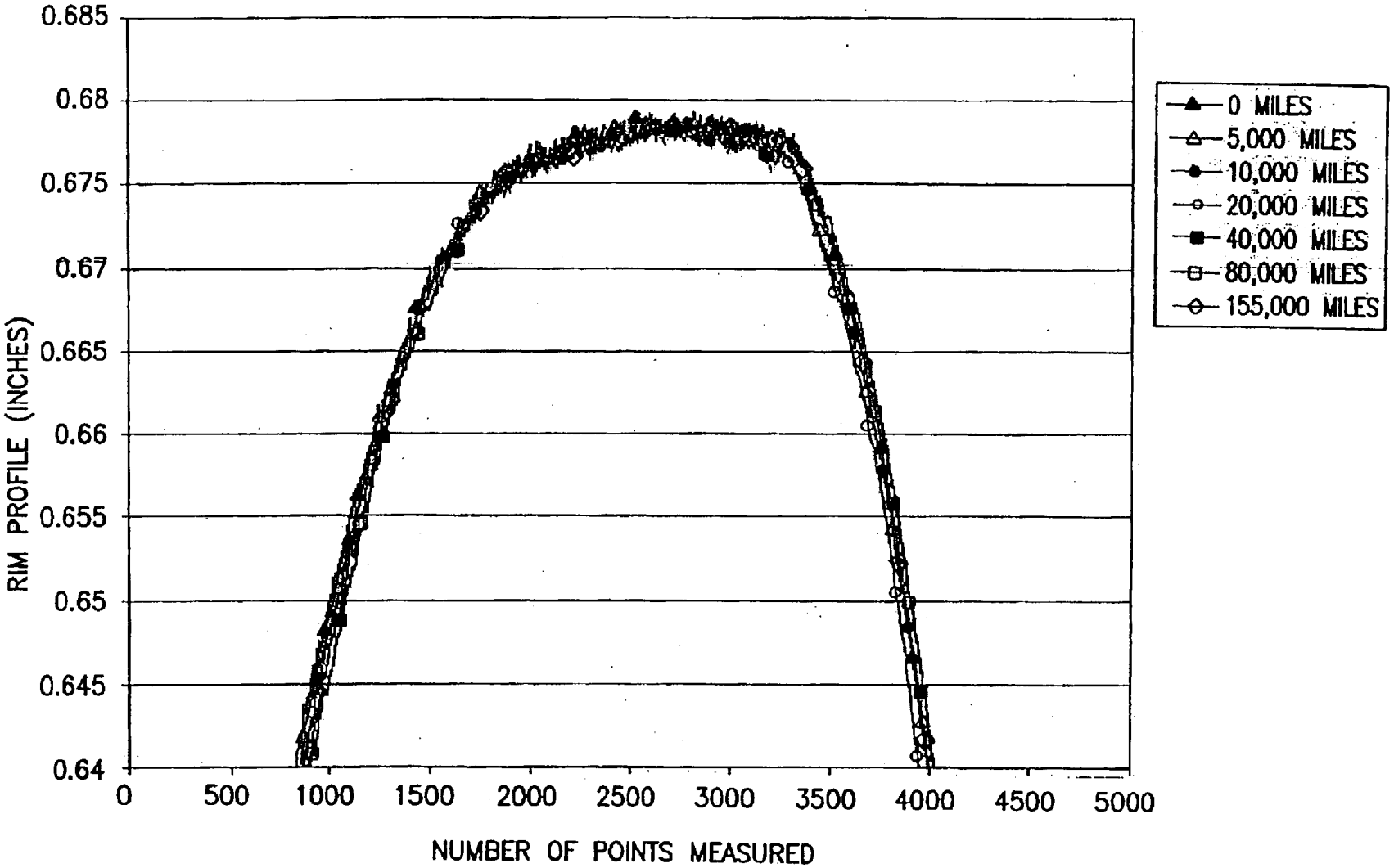
FIG. 9 is a graph of wear resistance of a vehicle wheel having a tungsten carbide coating applied to the closed end of the vehicle wheel.
Figure 10:
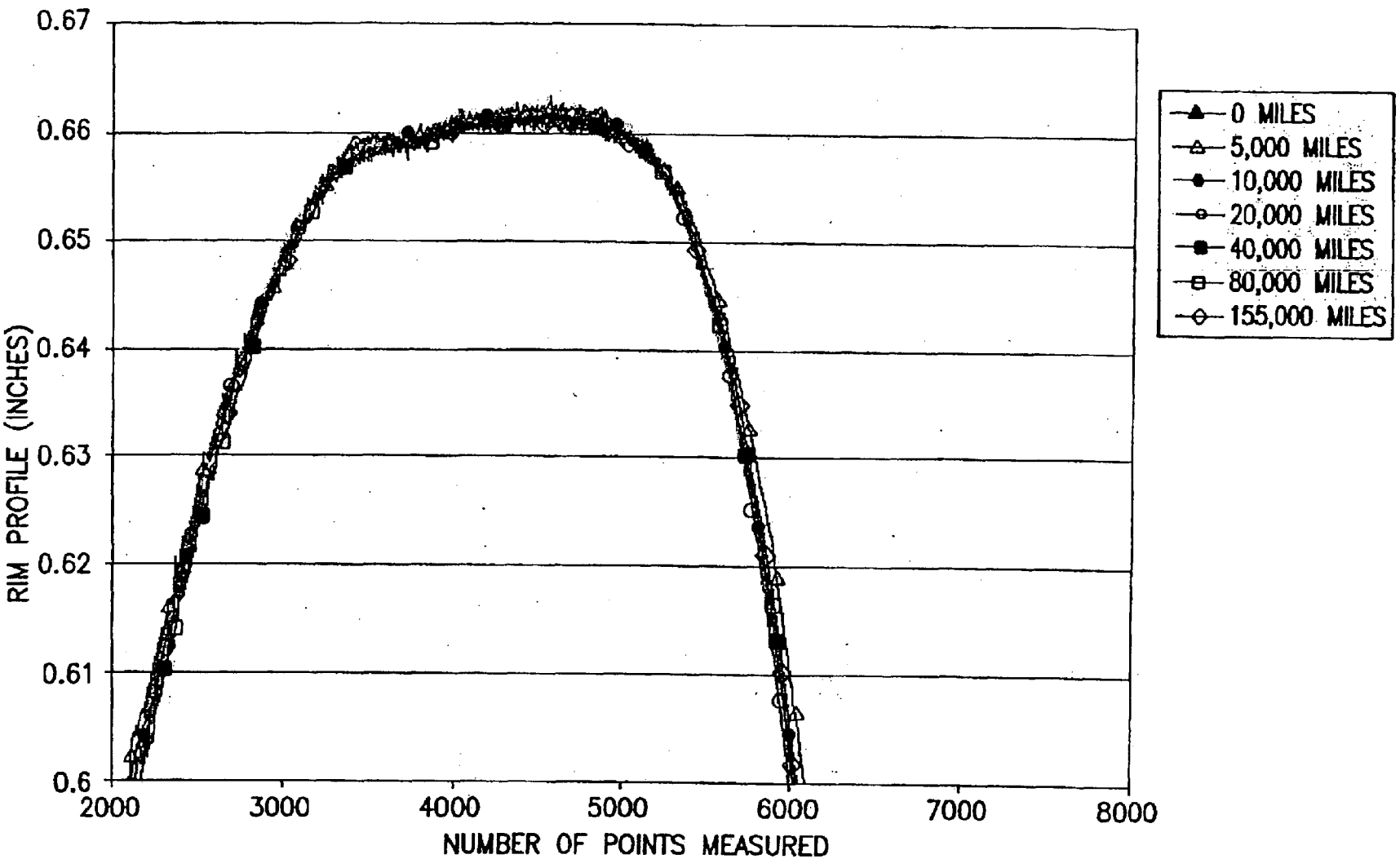
FIG. 10 is a graph of wear resistance of a vehicle wheel having a tungsten carbide coating applied to the open end of the vehicle wheel.

FIGS. 9 and 10 illustrate wear resistance of the closed end 26 and open end 28 of a vehicle wheel 10D having a tungsten-carbide coating 14, in particular, a tungsten carbide cobalt coating 14. The composition of the tungsten-carbide coating 14 includes 88% tungsten carbide and 12% cobalt and was applied to the vehicle wheel 10D to a thickness of 0.004–0.006 inch. The vehicle wheel 10D coated with tungsten-carbide provided the greatest wear resistance without any indication of wear even after 155,000 miles of use. The tungsten-carbide coating 14 provided the optimal coating composition for wear and corrosion resistance.

The coating 14 in accordance with the present invention also may be selected based upon factors such as the desired life of the vehicle wheel 10 and cost. For example, a longer lasting tungsten-carbide coating 14 would be more costly than a nickel-based superalloy coating 14 or an Al—Si coating 14. A vehicle wheel 10 necessary for applications of greater than 155,000 miles of use is preferably coated with the tungsten-carbide coating 14, which provides the greatest wear and corrosion resistance. Conversely, a vehicle wheel 10 that may only have a needed life of 40,000 miles of use may be coated with an Al—Si coating 14, which provides a more cost effective approach of increasing the wear resistance of the vehicle wheel 10.

In another embodiment of the present invention, the wear resistant coating 14 may be applied to an existing vehicle wheel 10. For example, a vehicle wheel 10 that has been in use for 5,000 miles may still be coated in accordance with the present invention to increase wear and corrosion resistance. The existing vehicle wheel 10 is preferably coated in a similar manner as discussed previously. Initially, however, the surface of the existing vehicle wheel 10 may be prepared. The coating 14 is applied at least to the tire bead retaining flanges 16, 24 of the tire bead seat areas 17, 23 of the existing vehicle wheel 10. The surface of the existing vehicle wheel 10 may be prepared by mechanically abrading the surface of the existing vehicle wheel 10, which may include mechanical roughening, knurling, and abrasive grit blasting of the surface of the vehicle wheel 10. The surface of the existing vehicle wheel 10 may also be prepared by chemical etching or by high-pressure water blasting of the surface of the existing vehicle wheel 10.

The existing vehicle wheel 10 and coating 14 preferably include materials each having coefficients of thermal expansion within a range of about 10%. The existing vehicle wheel 10 may be made of forged aluminum or cast aluminum. The coating 14 may include tungsten carbide, and/or cobalt and chrome, a nickel-based superalloy, aluminum and silicon carbide, or stainless steel. The coating 14 may be applied to a thickness of about 0.004–0.01 inch.

The coating 14 may be applied by cold spraying, thermal spraying, and triboelectric discharge kinetic spraying. The coating 14 may also be applied by high velocity combustion, low velocity combustion, plasma spray, and twin arc spraying. Optionally, the coating 14 may be applied by a method that adds a layer for improving wear conditions at temperatures up to about 1200° F.

In a further embodiment of the present invention, any type of vehicle component (not shown) subject to wear and corrosion may be coated with the coating 14 to increase the wear and corrosion resistance of the vehicle component. The vehicle component may include any other part of the vehicle that is subjected to wear by, for example, repeated frictional contact with another surface. The vehicle component is preferably coated in a similar manner as discussed hereinabove in connection with the vehicle wheel 10.

For example, the wear and corrosion coating 14 is applied onto at least a portion of the surface of the vehicle component. After the application of the coating 14, the coating 14 may be mechanically buffed. Optionally, the surface of the vehicle component may be prepared by mechanically abrading the surface of the vehicle component, which may include mechanical roughening, knurling, and abrasive grit blasting of the surface of the vehicle component. The surface of the vehicle component may also be prepared by chemical etching or by high pressure water blasting.

The vehicle component and coating 14 preferably include materials each having coefficients of thermal expansion within a range of about 10%. The vehicle component may be made of forged aluminum or cast aluminum. The coating 14 may include tungsten carbide, and/or cobalt and chrome, a nickel-based superalloy, aluminum and silicon carbide, or stainless steel. The coating 14 may be applied to a thickness of about 0.004–0.01 inch.

The coating 14 may be applied to the vehicle component by cold spraying, thermal spraying, and triboelectric discharge kinetic spraying. The coating 14 may also be applied by high velocity combustion, low velocity combustion, plasma spray, and twin arc spraying. Optionally, the coating 14 may be applied by a method that adds a layer for improving wear conditions at temperatures up to about 1200° F.

In addition to the various advantages discussed hereinabove with the present invention, another advantage is that the chemistry of the coating 14 may be tailored to provide a better method for controlling wear and corrosion resistance. This is helpful in a variety of environmental and operational conditions. Vehicle wheels 10 to be sold in a hotter, more humid region of the country may be custom coated with one type of coating 14, while those sold for principle use in wetter and/or colder regions may be custom coated with another embodiment of the coating 14.

While preferred embodiments of the present invention were described hereinabove, modifications and alterations of the present invention may be made without departing from the spirit and scope of the present invention. The scope of the present invention is defined in the appended claims and equivalents thereto.

What is claimed is:

1. A method of coating a vehicle wheel to increase wear and corrosion resistance of the vehicle wheel, comprising the steps of:

providing a vehicle wheel; and applying about 0.006 inch or less of a wear and corrosion resistant coating to a tire bead seat area of the vehicle wheel.

2. The method according to claim 1, wherein the coating is applied to a tire bead retaining flange or the vehicle wheel.

3. The method according to claim 1, wherein the vehicle wheel is made of forged aluminum.

4. The method according to claim 1, wherein the vehicle wheel is made of cast aluminum.

5. The method according to claim 1, wherein the coating comprises tungsten carbide.

6. The method according to claim 5, wherein the coating further comprises one of cobalt and chrome.

7. The method according to claim 1, wherein the coating comprises a nickel-based superalloy.

8. The method according to claim 1, wherein the coating comprises aluminum and silicon carbide.

9. The method according to claim 1, wherein the coating comprises stainless steel.

10. The method according to claim 1, wherein the coating comprises nickel, chromium, iron, silicon, and boron, and optionally including chromium carbide or tungsten carbide.

11. The method according to claim 1, wherein the coating is applied by a method selected from the group consisting of cold spraying, thermal spraying, and triboelectric discharge kinetic spraying.

12. The method according to claim 1, wherein the coating is applied by a method selected from the group consisting of high velocity combustion, low velocity combustion, plasma spray, and twin are spraying.

13. The method according to claim 1, wherein the coating is applied by a method for improving wear conditions at temperatures up to about 1200° F.

14. The method according to claim 1, further comprising the step of mechanically buffing tho coating.

15. The method of according to claim 1, further comprising the step of preparing the vehicle wheel by mechanically abrading a surface of tho vehicle wheel.

16. The method according to claim 15, wherein the step of mechanically abrading the surface of the vehicle wheel comprises one of mechanical roughening, knurling, and abrasive grit blasting at least the tire bead seat area of the vehicle wheel.

17. The method of according to claim 1, further comprising the step of preparing the vehicle wheel by chemically etching a surface of the vehicle wheel.

18. The method according to claim 1, further comprising the step of preparing the vehicle wheel by high pressure water blasting a surface of the vehicle wheel.

19. A coated wheel made according to the method of claim 1, wherein the coating comprises tungsten chrome carbide, optionally including cobalt, or a nickel-based superalloy and wherein the wheel is coated in at least a tire bead seat a of the vehicle wheel.

20. A coated wheel made according to the method of claim 1, wherein the coating comprises tungsten chrome carbide, optionally including cobalt, or a nickel-based superalloy and wherein the wheel is coated in at least a tire bead seat retaining flange of the vehicle wheel.

21. A vehicle wheel having a wear and corrosion resistant coating applied to at least a tire bead seat area of he vehicle wheel, the coating having a thickness of about 0.006 inch or less.

22. The vehicle wheel of claim 21, wherein the coating comprises tungsten carbide.

23. The vehicle wheel of claim 22, wherein the coating further comprises one of cobalt and chrome.

24. The vehicle wheel of claim 21, wherein the coating comprises a nickel-based superalloy.

25. The vehicle wheel or claim 21, wherein the coating is applied to a bead seat retaining flange.

26. A method of coating an existing vehicle wheel to improve wear and corrosion resistance of the vehicle wheel, comprising the steps of:

providing a used vehicle wheel;

preparing a tire bead seat area of the used vehicle wheel; and applying a wear and corrosion coating onto the tire bead seat area of the used vehicle wheel, said coating having a thickness of about 0.006 inch or less.

27. The method of claim 26, wherein the coating is applied to a tire bead retaining flange of the vehicle wheel.

28. The method according to claim 26, wherein the vehicle wheel is made of forged aluminum.

29. The method according to claim 26, wherein the vehicle wheel is made of cast aluminum.

30. The method according to claim 26, wherein the comprises tungsten carbide.

31. The method according to claim 26, wherein the coating further comprises one of cobalt and chrome.

32. The method according to claim 26, wherein the coating comprises a nickel-based superalloy.

33. The method according to claim 26, wherein the coating comprises aluminum and silicon carbide.

34. The method according to claim 26, wherein the coating comprises stainless steel.

35. The method according to claim 26, wherein the coating comprises nickel, chromium, iron, silicon, and boron, and optionally including chromium carbide or tungsten carbide.

36. The method according to claim 26, wherein the coating is applied by a method selected from the group consisting of cold spraying, thermal spraying, and triboelectric discharge kinetic spraying.

37. The method according to claim 26, wherein the coating is applied by a method selected from the group consisting of high velocity combustion, low velocity combustion, plasma spray and twin are spraying.

38. The method of according to claim 26, wherein said preparing step includes mechanically abrading at least the tire bead seat area of the vehicle wheel.

39. The method according to claim 38, wherein said mechanically abrading step comprises one of mechanical roughening, knurling, and abrasive grit blasting the tire bead seat area of the vehicle wheel.

40. The method according to claim 26, wherein said preparing step includes chemically etching at least the tire bead seat area of the vehicle wheel.

41. The method according to claim 26, wherein preparing step includes high pressure water blasting at least the tire bead seat area of the vehicle wheel.

* * * * *

US006872425C1

(12) EX PARTE REEXAMINATION CERTIFICATE (9340th)

United States Patent
Kaufold et al.

(10) Number: US 6,872,425 C1
(45) Certificate Issued: Oct. 5, 2012

(54) COATED VEHICLE WHEEL AND METHOD

(75) Inventors: Roger W. Kaufold, Pittsburgh, PA (US); Neville C. Whittle, Irwin, PA (US); Edward P. Patrick, Murrysville, PA (US); A. Victor Pajerski, New Kensington, PA (US)

(73) Assignee: Alcoa Inc., Pittsburgh, PA (US)

Reexamination Request:
No. 90/012,093, Jan. 12, 2012

Reexamination Certificate for:

| | |
|---|---|
| Patent No.: | **6,872,425** |
| Issued: | **Mar. 29, 2005** |
| Appl. No.: | **10/672,455** |
| Filed: | **Sep. 25, 2003** |

Related U.S. Application Data

(60) Provisional application No. 60/413,359, filed on Sep. 25, 2002.

(51) Int. Cl.

| | |
|---|---|
| ***B05D 1/02*** | (2006.01) |
| ***B05D 1/08*** | (2006.01) |
| ***B60B 21/10*** | (2006.01) |
| ***B60B 21/00*** | (2006.01) |
| ***C23C 4/00*** | (2006.01) |
| ***C23C 4/04*** | (2006.01) |
| ***C23C 4/18*** | (2006.01) |

(52) U.S. Cl. ..... 427/404; 301/95.101; 427/290; 427/327; 427/355; 427/419.1; 427/450; 427/455; 427/569

(58) Field of Classification Search ..... None
See application file for complete search history.

(56) References Cited

To view the complete listing of prior art documents cited during the proceeding for Reexamination Control Number 90/012,093, please refer to the USPTO's public Patent Application Information Retrieval (PAIR) system under the Display References tab.

*Primary Examiner* — Jerry D Johnson

(57) ABSTRACT

A method of coating a vehicle wheel to increase wear and corrosion resistance of the vehicle wheel, includes the steps of providing a vehicle wheel and applying a wear and corrosion resistant coating onto a surface of the vehicle wheel. The coating is applied to at least a tire bead retaining flange of the vehicle wheel. The coating is of particular use with vehicle wheels made of forged aluminum. The coating is selected from tungsten carbide, optionally including cobalt or chrome, a nickel-based superalloy, aluminum and silicon carbide, or stainless steel.

The coating is typically applied to a thickness of about 0.004-0.01 inch. The surface of the vehicle wheel may be prepared by mechanically abrading the surface or chemically etching the surface of the vehicle wheel. The coating may be applied by cold spraying, thermal spraying, or triboelectric discharge kinetic spraying and other similar processes.

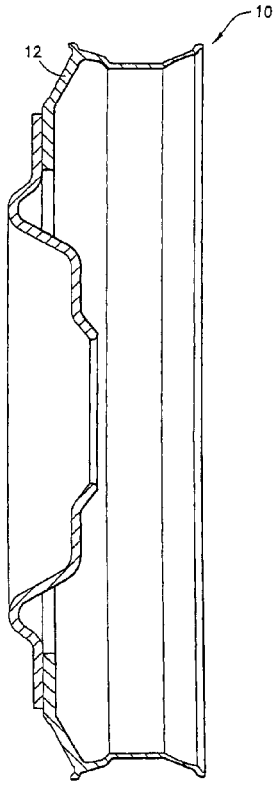

EX PARTE REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

Claims 1-41 are cancelled.

* * * * *